US009431193B2

(12) United States Patent
Sadowski

(10) Patent No.: US 9,431,193 B2
(45) Date of Patent: Aug. 30, 2016

(54) LOW CURRENT SWITCH

(71) Applicant: Walter A. Sadowski, Newington, CT (US)

(72) Inventor: Walter A. Sadowski, Newington, CT (US)

(73) Assignee: Carling Technologies, Inc., Plainville, CT (US)

( * ) Notice: Subject to any disclaimer, the term of this patent is extended or adjusted under 35 U.S.C. 154(b) by 26 days.

(21) Appl. No.: 14/201,384

(22) Filed: Mar. 7, 2014

(65) Prior Publication Data

US 2014/0251777 A1 Sep. 11, 2014

Related U.S. Application Data

(60) Provisional application No. 61/774,286, filed on Mar. 7, 2013.

(51) Int. Cl.

| | |
|---|---|
| ***H01H 19/46*** | (2006.01) |
| ***H01H 23/28*** | (2006.01) |
| ***H01H 23/20*** | (2006.01) |

(52) U.S. Cl.

CPC ..... *H01H 23/28* (2013.01); *H01H 23/205* (2013.01); *Y10T 29/49105* (2015.01)

(58) Field of Classification Search

CPC .. B60Q 1/1476; H01H 13/365; H01H 19/46; H01H 23/162; H01H 13/36

USPC ..... 200/339, 527, 553, 11 J, 447

See application file for complete search history.

(56) References Cited

U.S. PATENT DOCUMENTS

| | | | | |
|---|---|---|---|---|
| 2,267,203 | A * | 12/1941 | Krieger | 200/437 |
| 2,526,850 | A | 10/1950 | Charbonneau | |
| 4,764,649 | A * | 8/1988 | Sakai et al. | 200/412 |
| 5,343,007 | A | 8/1994 | Roeser et al. | |
| 6,600,122 | B1 | 7/2003 | Czarnecki et al. | |
| 6,930,269 | B1 * | 8/2005 | Lee et al. | 200/553 |
| 2012/0118713 | A1 | 5/2012 | Sadowski et al. | |

OTHER PUBLICATIONS

International Search Report Application No. PCT/US2014/021539 Completed: Jun. 5, 2014; Mailing Date: Jun. 23, 2014 7 pages.

* cited by examiner

*Primary Examiner* — Renee Luebke
*Assistant Examiner* — Ahmed Saeed
(74) *Attorney, Agent, or Firm* — St. Onge Steward Johnston & Reens, LLC

(57) ABSTRACT

A low current switch has a flexible movable contact that can be deflected by an actuator. In some implementations the switch may permit a low current switch to be manufactured using elements of a high current switch without requiring large amounts of precious metal. The flexible movable contact may be arranged as one or more cantilevers that are deflected using a rocking actuator. The actuator interacts with the movable contact in such a way as to provide tactile feedback to an operator comparable to a high current switch having a rigid movable contact. Also described are a set of low and high current switches, components of a low current switch, and a method of manufacturing a low current switch.

20 Claims, 4 Drawing Sheets

LOW CURRENT SWITCH

FIELD OF THE INVENTION

The invention relates to the design of electrical switches, and more specifically to a low-current switch design.

BACKGROUND OF THE INVENTION

In many electrical systems it is common to locate a low current switch next to a high current switch on a panel. This makes sense, for example, if a particular subsystem uses a high current switch as a power control, and a low current switch as a signaling control.

Typically, it is also desirable for such switches to have the same functional "feel" so as to maintain a common tactile response for the operator. This is especially the case where the switches have a similar or matching exterior design. If these switches "feel different" during switching, the operator may mistakenly believe that one of the switches is beginning to fail, or may think that the overall fit and finish of the system is poor.

Under these aesthetic constraints, it is tempting to simply use a duplicate high current switch for a low current application, on the assumption that it will be able to handle the lower current just as well. However, the design requirements for low current switches are considerably different than for high current switches. For this reason, it is often impossible or impractical to substitute switches in this way. The challenge then is to devise an economical way to create a low current switch that has a "feel" that matches a corresponding high current switch to an acceptable degree.

In order to approach this problem, it is important to consider the design requirements of each of these types of switches. Some of the major design differences between low and high current switches relate to the effects of corrosion and switch bounce.

Low current switches are more susceptible to corrosion of contacting surfaces than switches used in high current applications, and must be designed to more aggressively minimize corrosion. Low current switches are also frequently used in applications that are sensitive to noisy signal transitions, and are best designed to minimize this effect, which is usually not an issue in high current applications. These differing requirements have an effect on the structure, "feel," and manufacturing cost of the switch.

Using typical materials, corrosion can build up on the contacting surfaces over time, particularly in wet or corrosive environments. This corrosion forms an insulating barrier that increases resistance and interferes with the electrical contact.

High current switches can tolerate a certain degree of tarnish or corrosion on contacting surfaces because the high current is sufficient to "punch through" the corrosion. For a given switch design, the minimum current required to break through the expected corrosion resistance is commonly known as the "wetting current".

Wetting current is the lowest current that an electronic circuit can operate under. Below the wetting current, current will not flow at all. However in low current applications, the current is usually below the wetting current for a typical high current switch. This means that the current in the system may be insufficient to "punch through" the corrosion that forms on the contacting surfaces, eventually causing the switch to fail.

In order to address this issue for low current applications, the contact points and certain types of conducting joints (such as pivot or bearing surfaces) within the switch must be made from or coated with a minimally corroding substance in order to prevent the gradual buildup of tarnish or other corrosion.

Gold plating is a standard choice for providing a highly conductive and non-corroding surface. However gold is very expensive, with costs increasing dramatically in recent years.

Because it is so expensive, the gold plating used in switches is often extremely thin in order to reduce costs. If the coating is made too thin, however, this can negatively impact reliability by making the switch overly susceptible to wear-through and eventual corrosion.

This means that adapting a typical pivoting high-current contact switch for use in low current applications by simply adding gold plating can represent a significant increase in materials cost, and may not be sufficient to produce a low current switch having a sufficiently long life.

Because of these issues, a low current switch based on a high current design may need to be structurally redesigned to minimize the amount of gold that is required. However, these modifications have the potential to change the feel of the switch.

Low current applications are also often susceptible to switch contact bounce. This is particularly true in digital circuits where an unambiguous transition between signaling levels can be important for proper operation.

Switch bounce occurs when the contacts of the switch open and close. As the contacts come together, the mass, inertia, and surface characteristics of the contact cause the contacts to "bounce" or rapidly open and close several times before coming to rest in the closed position. A similar effect can occur as the contacts separate and before they come to rest in the open position.

Because high current circuits are usually not especially sensitive to noisy switching signals, such switches are frequently designed to handle the desired current load without regard to bounce. Thus, the structures of a high current switch may produce signals that are too noisy for some low-current digital signaling applications.

In order to use such a switch for low current applications, the circuit being switched may need to be "debounced" using additional components in order to create a reliable signal. However debouncing circuitry requires additional cost to manufacture. In some high speed digital applications a delay is introduced to adequately debounce a switch designed for high current use.

Because of these issues, a low current switch based on a high current design may need to be structurally redesigned to minimize switch bounce. But as with a redesign to reduce corrosion with a minimum of gold plating, these modifications have the potential to alter the feel of the switch.

It is therefore desired to provide a low current switch that addresses these deficiencies.

SUMMARY OF THE INVENTION

Objects of the invention are achieved by providing a switch which includes a flexible element fixedly attached within a housing, which extends from a fixedly attached portion to an unattached end and is in electrical communication with a first terminal; a contact in electrical communication with a second terminal; an actuator which is configured to move between a first position and a second position and to bias the flexible element such that the unattached end flexes toward the contact when the actuator is moved from the second position to the first position; a switch handle having a handle bearing surface in contact with the actuator and configured to move the actuator between the second position and the first position; and, a return assist attached to the flexible element and configured to bias the unattached end away from the contact. The flexible element may include a flat spring.

In some implementations, the return assist includes a tongue attached at the unattached end of the flexible element and extending toward the fixedly attached portion. The switch may include a projection disposed to contact the return assist, and the projection may be configured to bias the flexible element away from the contact.

In some implementations, when the actuator is in the first position, the flexible element is in electrical communication with the contact. The actuator may include a stopping surface configured to prevent the actuator from travelling from the second position past the first position.

In some implementations, the handle bearing surface comprises a roller. In some implementations, the handle bearing surface is configured to slide against the actuator. In some implementations, the switch handle comprises a spring piston, and the spring piston may bias the handle bearing surface against the actuator. In some implementations, the flexible element is fixed by staking, and optionally, may be staked to the first terminal.

Other objects of the invention are achieved by providing a switch that includes a flexible element rigidly attached within a housing, which extends from a rigidly attached portion to an unattached end and is in electrical communication with a first terminal; a contact in electrical communication with a second terminal; an actuator which is configured to move between a first position and a second position and to bias the flexible element such that the unattached end flexes toward the contact when the actuator is moved from the second position to the first position; a switch handle having a handle bearing surface in contact with the actuator and configured to move the actuator between the second position and the first position; and, a return assist attached to the flexible element and configured to bias the unattached end away from the contact.

Further objects of the invention are achieved by providing a switch that includes a flexible element non-pivotally attached with respect to a housing, which extends from a non-pivotally attached portion to an unattached end and is in electrical communication with a first terminal; a contact in electrical communication with a second terminal; an actuator which is configured to move between a first position and a second position and to bias the flexible element such that the unattached end flexes toward the contact when the actuator is moved from the second position to the first position; a switch handle having a handle bearing surface in contact with the actuator and configured to move the actuator between the second position and the first position; and, a return assist attached to the flexible element and configured to bias the unattached end away from the contact.

Still other objects of the invention are achieved by providing a switch that includes a flexible element disposed within a housing, which is in electrical communication with a first terminal; a contact in electrical communication with a second terminal; an actuator which is configured to move between a first position and a second position and to bias the flexible element toward the contact when the actuator is moved from the second position to the first position; a switch handle having a handle bearing surface in contact with the actuator and configured to move the actuator between the second position and the first position; and, a return assist attached to the flexible element and configured to bias the unattached end away from the contact; where the switch actuator includes a first bearing surface about which the actuator is configured to pivot between the first position and the second position, a second bearing surface configured to apply pressure to the flexible element, and a third bearing surface configured to interact with the switch handle.

In some implementations, the actuator includes a fourth bearing surface configured to interact with a stop such that the actuator is prevented from pivoting beyond the first position from the second position.

In accordance with another aspect of the present invention, a method of manufacturing a switch includes providing a flexible element fixedly attached within a housing, which extends from a fixedly attached portion to an unattached end and is in electrical communication with a first terminal; providing a contact in electrical communication with a second terminal; providing an actuator which is configured to move between a first position and a second position and to bias the flexible element such that the unattached end flexes toward the contact when the actuator is moved from the second position to the first position; providing a switch handle having a handle bearing surface in contact with the actuator and configured to move the actuator between the second position and the first position; and, providing a return assist attached to the flexible element and configured to bias the unattached end away from the contact.

Further objects of the invention and its particular features and advantages will become more apparent from consideration of the following drawings and accompanying detailed description.

DETAILED DESCRIPTION OF THE INVENTION

Figure 1:
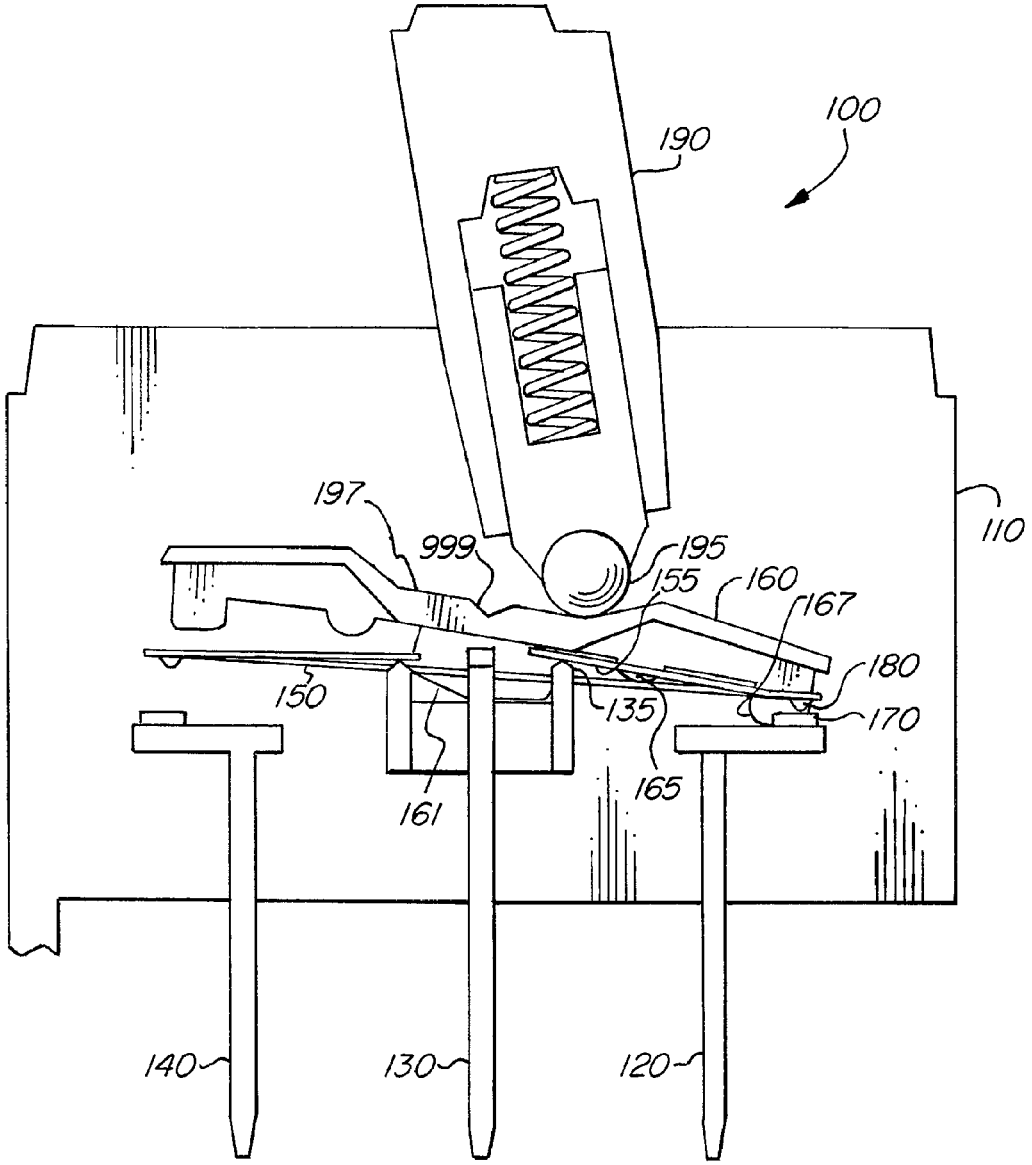
FIG. 1 is a cross-sectional view of a switch according to aspects of the invention.

FIG. 1 is a cross-sectional view of an example switch 100 which illustrates aspects of the invention.

Switch 100 is a single-pole double-throw ("SPDT") switch having a housing 110, first, second, and third terminals 120, 130, 140, and a flexible element 150 attached to terminal 130. Switch 100 may be adapted for use as a low-current switch, for example, in applications rated for 28 mA 12V or 14 mA 24V, or less.

In example switch 100, flexible element 150 is a flat spring which is made from of a suitable material that is electrically conductive. For example, flexible element 150 may be comprised of spring copper or another suitable metal, or may be comprised of a metalized plastic having the desired resiliency, flexibility, spring, and conductive properties.

Actuator 160 is disposed within housing 110 and is shown in a first position, where it biases flexible element 150 and contact 180 toward contact 170 such that terminal 130 and terminal 120 are in electrical communication. In some implementations, Contacts 170 and 180 may include a "contact tape." In some implementations, contacts 170 and 180 may each include an elongated angled structure, and be configured such that the elongated angled structures are disposed substantially at right angles to one another, and such that they contact at a crossing point. This can have the advantages of reducing switch bounce and increasing the life of the contacts. The use of an angled structure in this way can also have the advantage of helping to break through any oxide that may have formed on the contact tape due to the increased pressure focused on a small contact point. Further, the use of an angled structure may also have the advantage of reducing the chances of interference due to particulate matter settling on the contacts, due to their small contacting surface area. Contact 180 may be omitted in some configurations.

Switch handle 190 interacts with actuator 160 in order to move it between the first position shown and other positions. Switch handle 190 is shown featuring a spring-piston arrangement incorporating a roller 195 for engagement with a surface 197 of actuator 160.

Actuator 160 has a bearing surface 165 which presses on flexible element 150 when actuator 160 is in the first position shown, in order to bias flexible element 150 toward contact 170.

In some implementations, the use of a bearing surface to bias a flexible element in this way can have the advantage of reducing the amount of bounce exhibited at the contacts 170, 180 by absorbing impact energy from the mechanism.

Actuator 160 also has a stopping surface 167 which prevents actuator 160 from travelling past the first position in one direction. This can have the advantage of preventing excess strain on flexible element 150, although stopping surface 167 may be omitted without departing from some aspects of the invention.

Flexible element 150 is shown with a return-assist 155 that interacts with projection 135 to further bias flexible element 150 away from contact 170. This can have the advantage of improving the break-contact performance of flexible element 150 when actuator 160 is moved out of the first position shown in FIG. 1, may increase the durability of flexible element 150, and may resist the effect of material fatigue tending decrease the contact gap over the life of the switch. However, in some implementations return-assist 155 and projection 135 may be omitted without departing from some aspects of the invention. In some implementations, projection 135 may be formed in one piece with, or be anchored or attached to terminal 130. In some implementations, projection 135 may be formed in one piece with, or be anchored or attached to housing 110.

Figure 2:
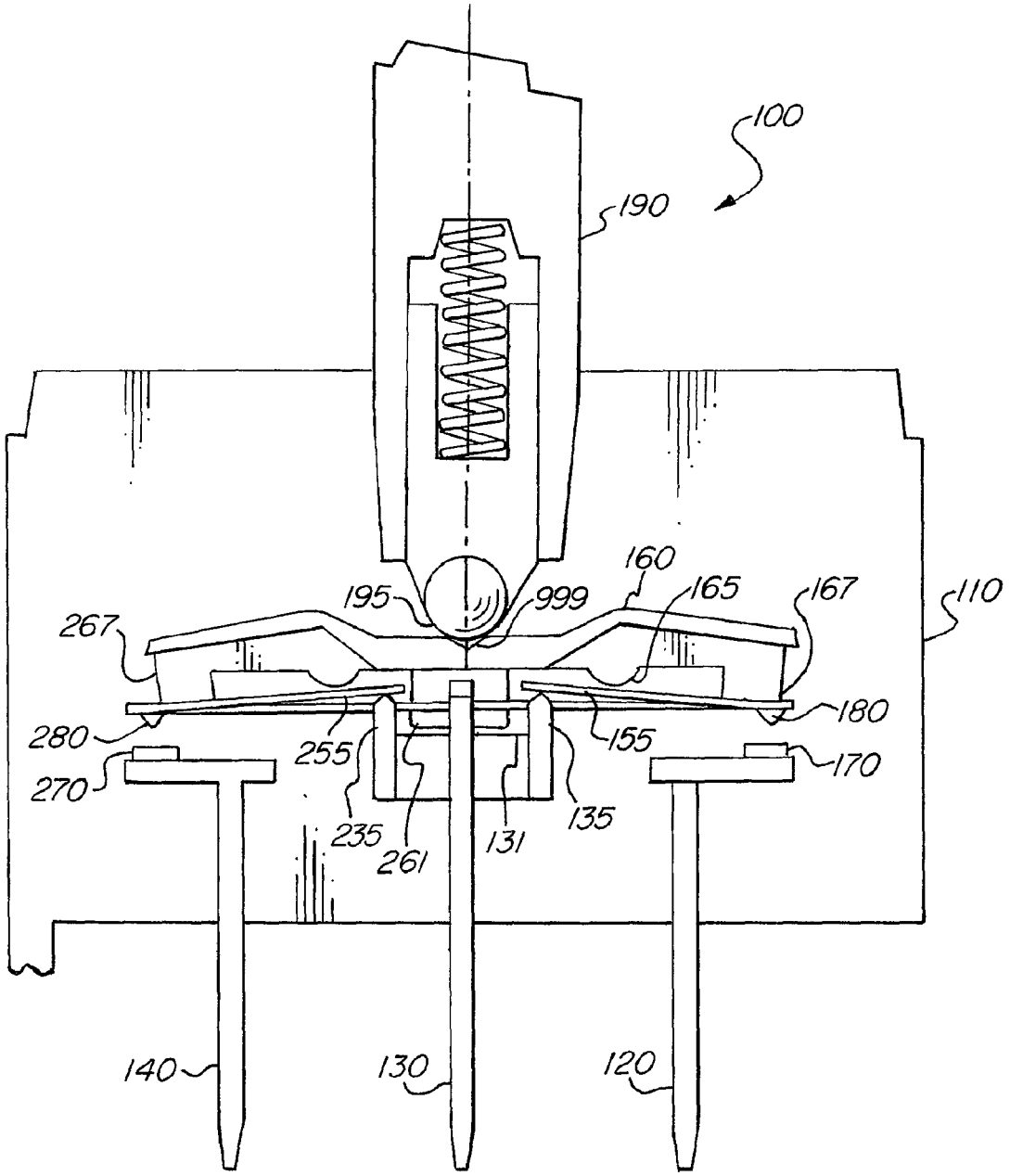
FIG. 2 is another cross-sectional view of the switch shown in FIG. 1, illustrating a second position of the switch.

FIG. 2 is another cross-sectional view of switch 100, illustrating a second position of switch 100.

In the second position shown, switch handle 190 and actuator 160 are shown in a neutral second position. A detent 999 is provided in actuator 160 which engages with roller 195 to assist in providing a stable "center-off" position. However, those having skill in the art will appreciate that detent 999 may be omitted, such as when configuring switch 100 to operate without a stable center-off position. After the actuator 160 moves from the first position (shown in FIG. 1) to the second position, bearing surface 165 no longer biases flexible element 150 (or the bias is reduced). The spring action of flexible element 150 biases both flexible element 150 and contact 180 away from contact 170 such that terminal 130 and terminal 120 are no longer in electrical communication. Return-assist 155 also interacts with projection 135 to bias flexible element 150 and contact 180 away from contact 170.

In FIG. 1, actuator 160 includes a rocking surface 161 seated on a pivot surface 131 of housing 110. Rocking surface 161 may be rounded or pointed as desired, in order to configure switch 100 as a two-position switch. FIG. 2 shows rocking surface 261, which is configured as a flat surface having two corners. The configuration of rocking surface 261 may be used to configure switch 100 as a three-position center-off switch, alone or in combination with detent 999. However, other pivot structures may be used.

As illustrated in FIGS. 1 and 2, switch 100 also includes a terminal 140 having a contact 270, a contact 280, bearing surface 265, stopping surface 267, return-assist 255, and projection 235. Each of these components operate and interact with one another in the same manner as terminal 120, contact 170, contact 180, bearing surface 165, stopping surface 167, return-assist 155, and projection 135 respectively, such that movement from the second position to a third position of the switch (not shown) will cause bearing surface 265 to bias flexible element 150 and contact 280 toward contact 270 such that terminal 140 and terminal 130 are in electrical communication. The third position (not shown) is functionally symmetrical with the first position shown in FIG. 1. In this configuration, terminal 130 is a common terminal of switch 100.

The second position shown in FIG. 2 represents a center-off position of the SPDT arrangement of switch 100; however, those having skill in the art will appreciate that the components can be configured to eliminate the stable center-off position.

Further, those having skill in the art will appreciate that switch 100 can be reconfigured as a single-pole-single-throw ("SPST") switch (not shown) by omitting the structures associated with the third position (not shown).

Figure 3:
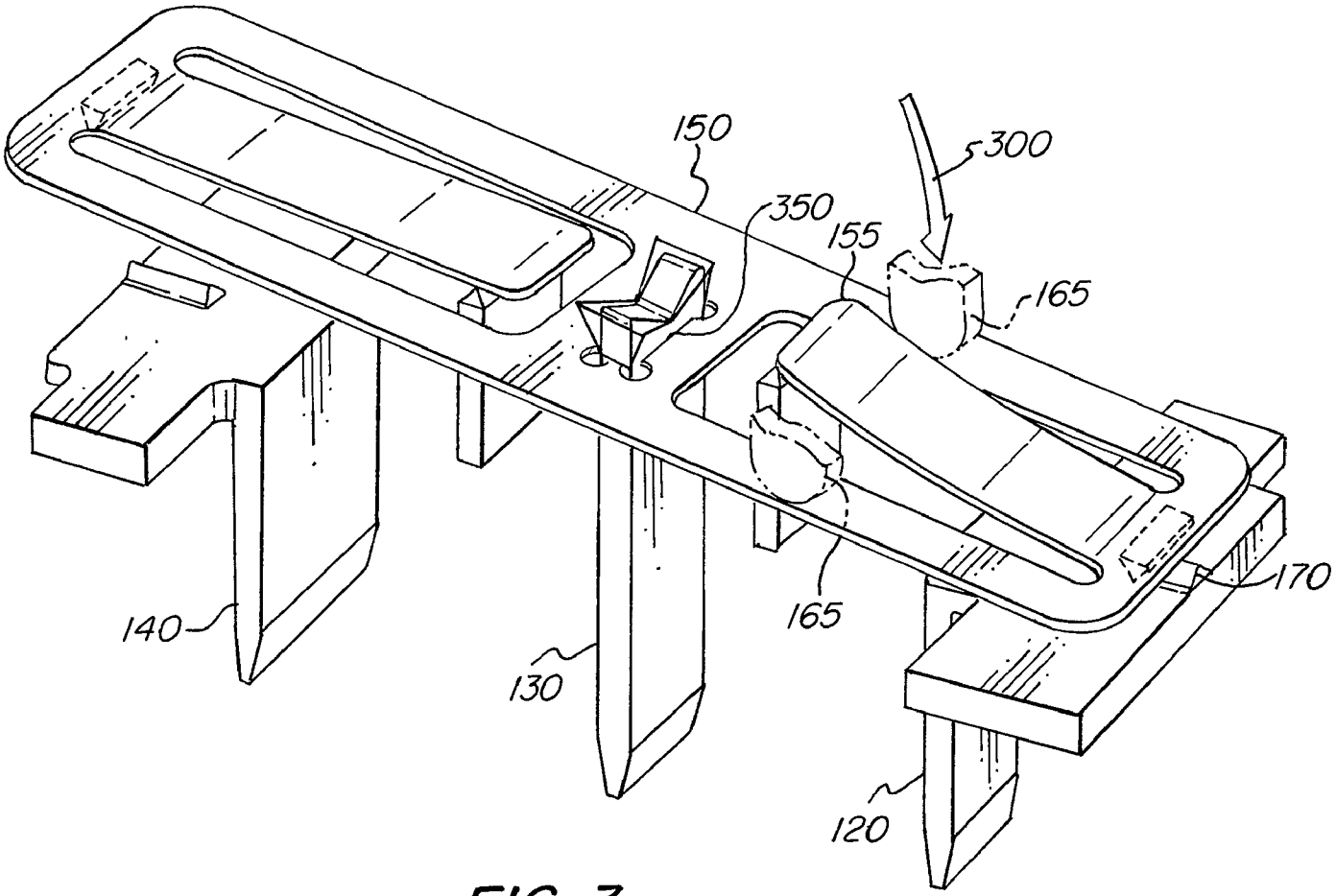
FIG. 3 is a three-dimensional view of components of the switch shown in FIG. 1.

FIG. 3 is a three-dimensional view illustrating some of the components of switch 100.

Bearing surface 165 is shown biasing flexible element 150 and contact 180 toward contact 170 in the direction of arrow 300 as a force is applied to the actuator 160 by switch handle 190. At the same time, both return-assist 155 and other portions of flexible element 150 resist the applied force. In some implementations, bearing surface 165 contacts flexible element 150 at a compliant location. This can have the advantage of reducing contact bounce. Bearing surface 165 may also comprise multiple bearing surfaces each biasing flexible element 150.

Flexible element 150 is shown anchored by connection 350 to a portion of terminal 130. Connection 350 may be formed by staking flexible element 150 to terminal 130, although other types of connections are possible, such as ultrasonic bonding, spot-welding, or soldering, for example. Because a staked connection may be considered to be a high-pressure metal-to-metal joint, the joint does not require gold plating for low-current applications.

The electrically contacting portions of switch 100, i.e. contacts 170, 180, 270, and 280 may be plated, clad, or otherwise covered with gold or another minimally corroding material. Because only these surfaces of switch 100 require protection from contact oxidation in low current applications, switch 100 may have the advantage of reducing the cost of producing the switch by decreasing the amount of precious metal required.

In example switch 100, flexible element 150 can be described as forming a pair of cantilever springs; one extending toward terminal 120, and the other extending toward terminal 140, each from a fixed end formed by connection 350. It will be evident to those having skill in the art that switch 100 could be reconfigured as a single-throw switch by eliminating one of the cantilevers and its associated components and geometry within the switch.

Return-assist 155 can be described as another cantilever having a fixed end formed from a free end of the flexible element 150, and having a free end extending toward the connection 350. The free end and sides of return-assist 155 are separated from other portions of flexible element 150 by a gap, cut, and/or slit through flexible element 150, and return-assist 155 may be machined, stamped, etched, or otherwise formed from or with flexible element 150. In alternate configurations, a return-assist may be fabricated from a separate piece (not shown) and attached to flexible element 150.

Figure 4:
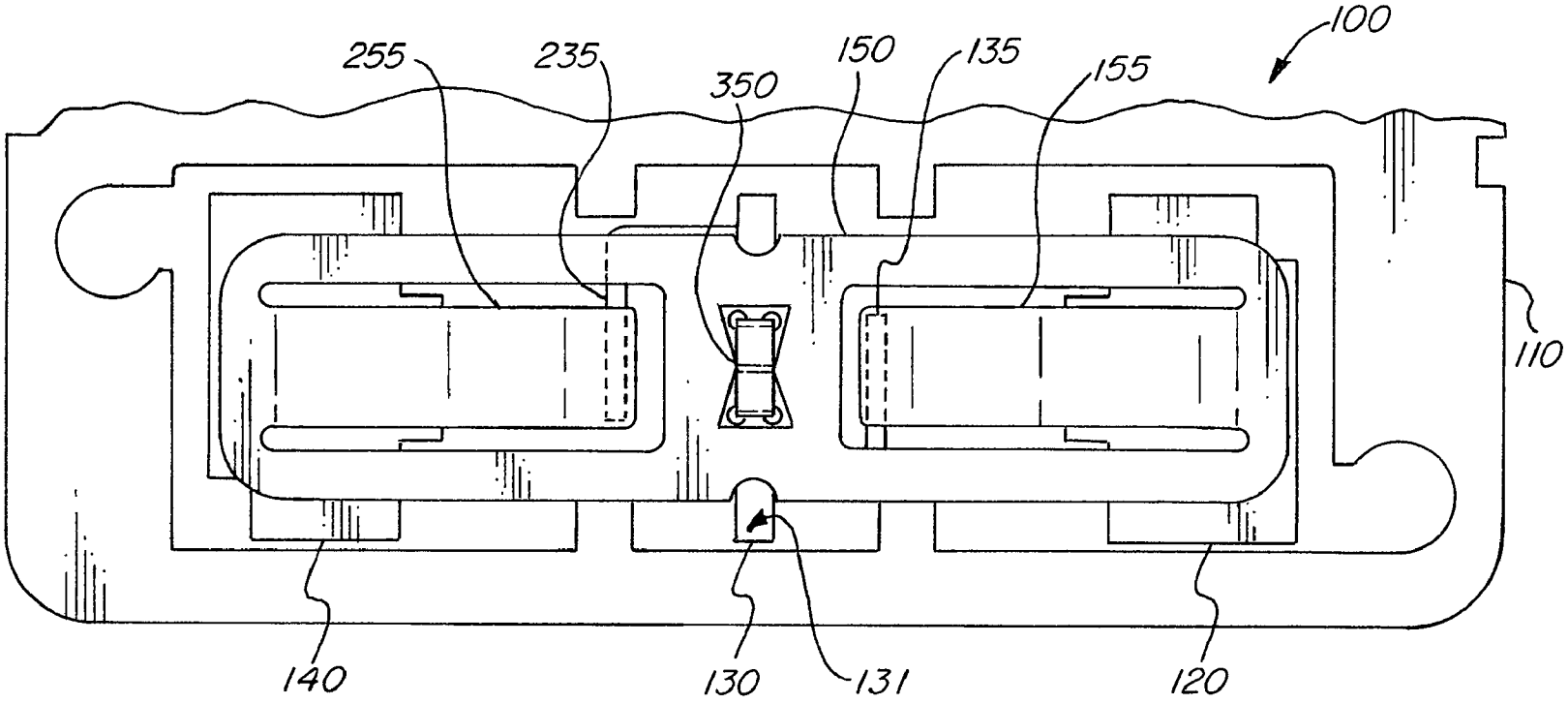
FIG. 4 is another cross-sectional view of the switch shown in FIG. 1.

FIG. 4 is another cross-sectional view of the switch 100 shown in FIG. 1, further illustrating the geometry of flexible element 150.

Although the invention has been described with reference to a particular arrangement of parts, features and the like, these are not intended to exhaust all possible arrangements or features, and indeed many modifications and variations will be ascertainable to those of skill in the art.

What is claimed is:

1. A switch comprising:

a flexible element fixedly attached within a housing, which extends from a fixedly attached portion to an unattached end and is in electrical communication with a first terminal;

said flexible element having an elongated opening formed therein, the opening defined by a first end and a second end;

a contact in electrical communication with a second terminal;

an actuator having a bearing surface which is configured to move between a first position and a second position and to bias the flexible element such that the unattached end flexes toward the contact when the actuator is moved from the second position to the first position;

a switch handle having a handle bearing surface in contact with the actuator and configured to move the actuator between the second position and the first position; and a return assist formed in the elongated opening in said flexible element, said return assist having first and second ends defining a length, the first end of said return assist affixed to said flexible element, the return assist being configured to bias the unattached end of the flexible element away from the contact;

said bearing surface contacting a lateral surface of said flexible element at a location between the first and second ends of said return assist.

2. The switch of claim 1, wherein the return assist comprises a tongue attached at the unattached end of the flexible element and extending toward the fixedly attached portion.

3. The switch of claim 1, further comprising a projection disposed to contact the return assist.

4. The switch of claim 3, wherein the projection is configured to bias the flexible element away from the contact.

5. The switch of claim 1, wherein when the actuator is in the first position, the flexible element is in electrical communication with the contact.

6. The switch of claim 1, wherein the flexible element comprises a flat spring.

7. The switch of claim 1, wherein the actuator comprises a stopping surface configured to prevent the actuator from travelling from the second position past the first position.

8. The switch of claim 1, wherein the handle bearing surface comprises a roller.

9. The switch of claim 1, wherein the handle bearing surface is configured to slide against the actuator.

10. The switch of claim 1, wherein the switch handle comprises a spring piston.

11. The switch of claim 10, wherein the spring piston biases the handle bearing surface against the actuator.

12. The switch of claim 1, wherein the actuator comprises an actuator bearing surface configured to contact the flexible element.

13. The switch of claim 12, wherein the actuator bearing surface contacts the flexible element at a compliant location.

14. The switch of claim 1, wherein the flexible element is fixed by staking.

15. The switch of claim 1, wherein the flexible element is staked to the first terminal.

16. The switch of claim 1, wherein the unattached end comprises a contact surface that is angled relative to a surface of the contact in electrical communication with a second terminal.

17. The switch of claim 1, wherein said actuator has two separate bearing surfaces where each bearing surface simultaneously contacts said flexible element at two different locations on a lateral side of said flexible element, where the two different locations are located between the first and second ends of said elongated opening.

18. A switch comprising:

a flexible element rigidly attached within a housing, which extends from a rigidly attached portion to an unattached end and is in electrical communication with a first terminal;

said flexible element having an elongated opening formed therein, the opening defined by a first end and a second end;

a contact in electrical communication with a second terminal;

an actuator having a bearing surface which is configured to move between a first position and a second position and to bias the flexible element such that the unattached end flexes toward the contact when the actuator is moved from the second position to the first position;

a switch handle having a handle bearing surface in contact with the actuator and configured to move the actuator between the second position and the first position; and a return assist formed in the elongated opening in said flexible element, said return assist having first and second ends defining a length, the first end of said return assist affixed to said flexible element, the return assist being configured to bias the unattached end of the flexible element away from the contact;

said bearing surface contacting a lateral surface of said flexible element at a location between the first and second ends of said return assist.

19. A switch comprising:

a flexible element non-pivotally attached with respect to a housing, which extends from a non-pivotally attached portion to an unattached end and is in electrical communication with a first terminal;

said flexible element having an elongated opening formed therein, the opening defined by a first end and a second end;

a contact in electrical communication with a second terminal;

an actuator having a bearing surface which is configured to move between a first position and a second position and to bias the flexible element such that the unattached end flexes toward the contact when the actuator is moved from the second position to the first position;

a switch handle having a handle bearing surface in contact with the actuator and configured to move the actuator between the second position and the first position; and a return assist formed in the elongated opening in said flexible element, said return assist having first and second ends defining a length, the first end of said return assist affixed to said flexible element, the return assist being configured to bias the unattached end of the flexible element away from the contact;

said bearing surface contacting a lateral surface of said flexible element at a location between the first and second ends of said return assist.

20. A method of manufacturing a switch comprising the steps of:

providing a flexible element fixedly attached within a housing, which extends from a fixedly attached portion to an unattached end and is in electrical communication with a first terminal, the flexible element having an elongated opening formed therein, the opening defined by a first end and a second end with a longitudinal length therebetween;

providing a contact in electrical communication with a second terminal;

providing an actuator having a bearing surface which is configured to move between a first position and a second position and to bias the flexible element such that the unattached end flexes toward the contact when the actuator is moved from the second position to the first position;

providing a switch handle having a handle bearing surface in contact with the actuator and configured to move the actuator between the second position and the first position; and providing a return assist formed in the elongated opening in said flexible element, the return assist having first and second ends defining a length, the first end of the return assist affixed to the flexible element, the return assist being configured to bias the unattached end of the flexible element away from the contact;

wherein the bearing surface contacts a lateral surface of said flexible element at a location between the first and second ends of the return assist.

* * * * *